United States Patent [19]

Morris

[11] 3,991,822

[45] Nov. 16, 1976

[54] METAL TUBE HAVING INTERNAL PASSAGES THEREIN

[75] Inventor: Jack Morris, Fort Lauderdale, Fla.

[73] Assignee: Olin Corporation, New Haven, Conn.

[22] Filed: Mar. 25, 1974

[21] Appl. No.: 454,090

Related U.S. Application Data

[62] Division of Ser. No. 343,740, March 22, 1973, Pat. No. 3,831,246.

[52] U.S. Cl. ..... 165/140; 138/115; 165/169

[51] Int. Cl.[2] ..... F28D 7/10

[58] Field of Search ..... 138/115; 165/169, 140

[56] References Cited

UNITED STATES PATENTS

| | | | |
|---|---|---|---|
| 2,626,130 | 1/1953 | Raskin | 165/169 X |
| 2,914,091 | 11/1959 | Barnes et al. | 165/169 X |
| 3,004,330 | 10/1961 | Wilkins | 138/115 X |
| 3,173,479 | 3/1965 | Heuer | 165/169 X |
| 3,335,789 | 8/1967 | Raskin | 165/169 X |

*Primary Examiner*—Albert W. Davis, Jr.
*Assistant Examiner*—Sheldon Richter
*Attorney, Agent, or Firm*—Robert H. Bachman

[57] ABSTRACT

A heat exchanger tube, and a method and apparatus for forming a heat exchanger tube are disclosed. The tube is formed from a metal strip having inflatable passages. The passages are inflated after the tube is formed. In use, one fluid flows through the tube and at least one fluid flows through the wall passages. Another fluid, contacting the exterior of the tube, may be employed.

3 Claims, 14 Drawing Figures

METAL TUBE HAVING INTERNAL PASSAGES THEREIN

This is a division of application Ser. No. 343,740, filed Nov. 22, 1973, now U.S. Pat. No. 3,831,246.

BACKGROUND OF THE INVENTION

Heat exchangers are usually designed so as to exchange heat between two different fluids. Typical examples are the condensation of steam during the distillation of water and the cooling of internal combustion engines by rejection of heat to the atmosphere through the radiator.

This invention relates to a new and improved type of heat exchange element and the process and apparatus for making and using it wherein the element consists of a tube having at least one continuous passage in the wall of the tube with the length of the wall passage significantly exceeding the length of the tube.

SUMMARY OF THE INVENTION

In its broadest form the intant invention comprises a tubular heat exchange element having at least one passage in the tube wall. In operation one fluid flows through the tube and a second fluid flows through the passage in the tube wall. The passage in the tube wall is constructed so that it has a length of at least 30% greater than the length of the tube.

In a preferred embodiment the extent of each wall passage is determined by a stop weld pattern applied between two strips of metal. The two strips are then pressure welded together to form a composite metal strip. The welded strip is formed into tubing, the longitudinal edges of the composite strip are welded together to form a tube, and the passages are formed by an inflation process applied to the unwelded areas of the composite strip.

In the normal course of such an inflation process, the resultant passages will protrude out from both the inner and outer surfaces of the tube. Another embodiment of this invention provides a means for inflation including the application of a differential pressure during the inflation process so as to eliminate the protrustion of the passage either on the inner or outer surface of the tube.

Another embodiment of this invention consists of a tubular element having more than one passage in the tube wall so that more than two fluids may be caused to flow through the wall passages.

Yet another embodiment of this invention encompasses the application of internal and/or external fins to the tubular member to improve heat transfer.

It is an object of this invention to provide an improved tubular heat exchange element comprising a tube having at least one continuous passage in the wall of the tube wherein the length of the passage is at least 30% greater than the length of the tube.

It is another embodiment of this invention to provide a process for making the above noted heat exchange element.

It is another object to provide an element and process as above wherein the passage or passages in the tube wall are defined by a stop weld pattern.

It is another object to provide an apparatus for the inflation of the passage or passages so that there is not protrusions from one of either the inner or the outer surfaces of the tube.

It is another object of this invention to provide fins, applied either to the inner or outer surface of the tube so as to improve heat transfer.

BRIEF DESCRIPTION OF DRAWINGS

The accompanying drawings are identified below.

DESCRIPTION OF THE INVENTION

Figure 1A:
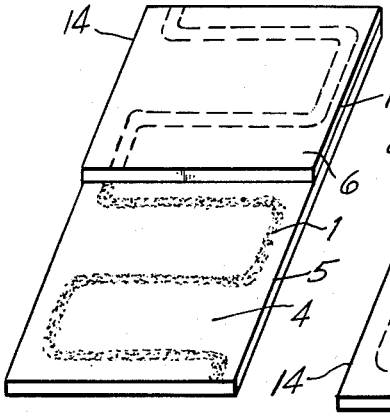
FIG. 1 shows two superimposed strips of metal with stop-weld material therebetween for forming the tubing of the present invention, with portions cutaway.
FIG. 1B shows the strips of FIG. 1A bonded together.

The instant invention comprises a new form of annular tubular heating exchange element wherein the tube has at least one continuous passage in the tube wall. In operation one fluid flows through the tube and a second fluid flows through the passage in the tube wall. The passage in the tube wall is so constructed that it has a length which significantly exceeds the tube length.

Of course, other embodiments are possible. For example, more than one wall passage may exist so that more than two fluids may flow through the heat exchanger. In another embodiment fins may be applied either to the interior or exterior of the tube so as to improve heat transfer. The instant invention also includes means for forming the tube wall passages so that the tubular heat exchange element has its interior surface or exterior surface smooth and free from the protrusion of the wall passages.

Referring now to the drawings, there is illustrated an exemplary process for making tubular sheet metal heat exchangers of the type described in the instant invention. While the concept of having passages in the wall of a heat exchanger tube can be applied to various types of tube manufacture, for example extrusions, the process to be described herein possess the advantage that the length of the wall passage can easily be varied and can significantly exceed the length of the tube. Because of the thin gage of the sheet metal employed, one can obtain better heat exchange performance as compared to the use of an extrusion or similar material. U.S. Pat. No. 3,004,330 issued to Wilkins describes a process for providing wall passage in a tube. However, the wall passages in the patent are constrained to be the same length as the tube which reduces their heat exchange efficiency. Additionally the process described in the instant invention is easier and more economical to perform and gives more accurate control of wall passage shapes, and spacing.

The integral sheet metal tubing useful with this invention may be fabricated from strip made by the methods disclosed in U.S. Pat. No. 2,690,002, granted to Grenell on Sept. 28, 1954, assigned to the assignee of the instant invention.

Figure 1B:
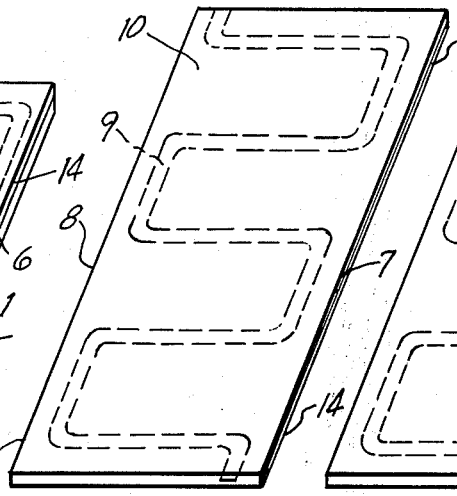
Figure 3:
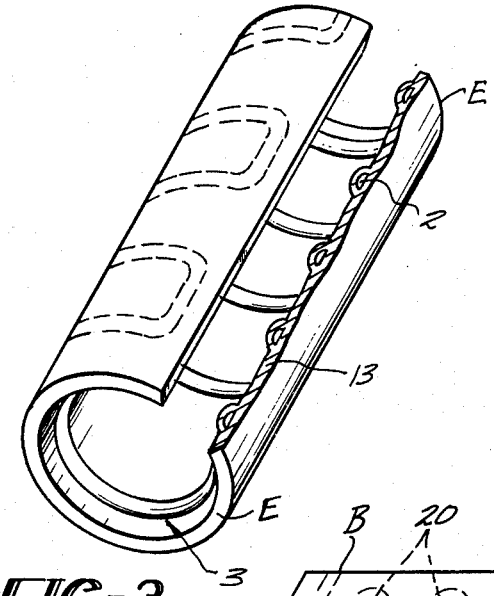
FIG. 3 shows the tube of FIG. 2 with passages distended therefrom, with portions cutaway.
Figure 2:
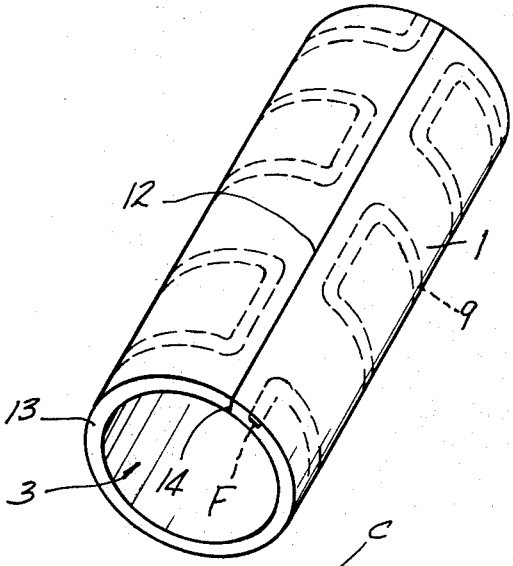
FIG. 2 shows the bonded strips of FIG. 1B formed into a tube.

Referring now to FIG. 1A, a pattern of weld inhibiting or stop-weld material 1 corresponding to a wall passage 2 of the tube 3 as shown in FIG. 3 as applied to a clean major surface 4 of a strip of metal 5. A second strip of metal 6 having a cleaned surface is superimposed on the surface 4 of the first strip 5, so that the cleaned surfaces are in contact, and the two strips are secured together to prevent relative motion therebetween. Thereafter, the two superimposed strips 5 and 6 are pressure welded together by rolling so that as shown in FIG. 1B the adjacent areas 7 of the strips 5 and 6 which are not separated by the stop-weld pattern 1 become bonded together. The rolling of the strips 5 and 6 results in reducing the thickness of the two superimposed strips 5 and 6 and in elongating the resultant blank 8 in the direction of rolling while the width of the resultant blank 8 remains substantially the same as the initial width of the strips 5 and 6. Following the rolling operation the blank 8 is usually softened, as by annealing, to make it more ductile, and if desired, it may be further rolled to the final gage desired and again softened as by annealing. The presence of stop-weld pattern 1 results in the retention of unwelded portions 9 extending internally within the blank 8 and sandwiched between its outer major surfaces 10 and 11. After softening, the blank 8, is formed into a tube 3 as shown in FIG. 2. The blank 8 is formed into the tube 3 by conventional means such as rolls or discs. This forming process results in a longitudinally extending seam 12 in the tube wall 13. This seam 12 results from the butting together of the major edges 14, of the blank 8.

This seam 12 is then joined, preferably by high frequency welding such as exemplified by the processes of U.S. Pat. Nos. 3,037,105, 2,794,108, and 2,818,488, granted May 29, 1962, May 28, 1957, and Dec. 31, 1957 respectively.

The unwelded area 9 of FIG. 2 is then inflated by conventional techniques. For example, an inflation needle can be inserted at a free end F of the stop-weld pattern pattern 1 and a fluid under pressure applied by the needle to inflate the wal passage 2 as shown in FIG. 3 in conformity with the stop-weld pattern 1.

Figure 4A:
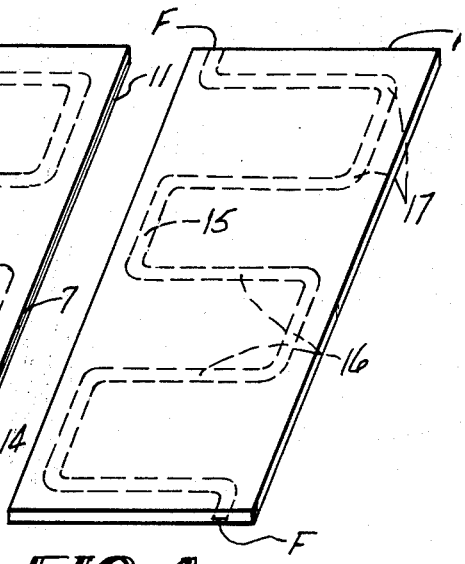
FIG. 4A is one embodiment of the present invention and shows a bonded blank for information into the tube of the present invention.

The resultant tube 3 having the wall passage 2 so inflated is shown in FIG. 3 in a cutaway view. It is evident that the wall passage 2 configuration may be varied as desired by merely changing the shape of the stop-weld pattern 1. FIGS. 4A, B and C illustrate a variety of patterns exemplary of those which could be used in accordance with this invention. It should be evident that any desired pattern could be formed and used in accordance with the instant invention.

FIG. 4A shows a blank A in accordance with this invention having a stop-weld pattern 15 with a generally transverse serpentine configuration. The pattern comprises a plurality of passes, 16, connected by a plurality of bend portions 17 with the passes, 16, oriented substantially transverse to the longitudinal direction of the blank A and therefore the longitudinal axis of the resultant tube. This pattern provides a tube as shown in FIG. 2 and an inflated tube as shown in FIG. 3. This form of pattern provides for termination of the wall passage, 3, at opposing ends E of the tube 3. A tube 3 formed from the blank A of FIG. 4A has a wall passage 2 having improved heat exchange efficiency due to the turbulence produced by the plurality of bends, 17, in the serpentine configuration.

A tube as in FIG. 3 formed from the blank A of FIG. 4A has a particular application in a coutercurrent type heat exchanger wherein the heat exchange fluid flowing through the tube 3 flows in an opposite direction to the fluid flowing in the wall passage 2.

Figure 4B:
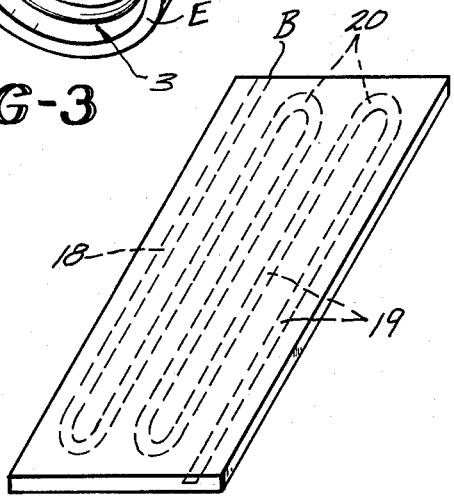
FIG. 4B is another embodiment of the present invention and shows another bonded blank for formation into the tube of the present invention.
Figure 5:
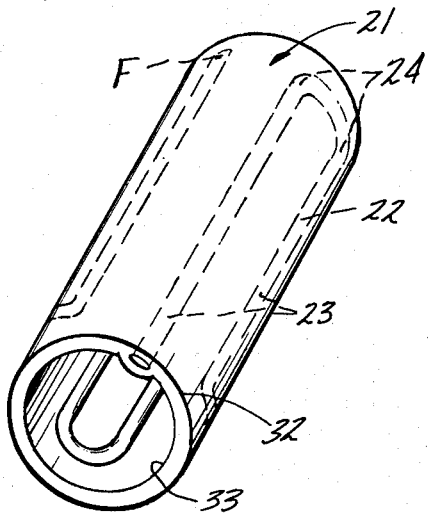
FIG. 5 shows a representative tube prepared from the blank of FIG. 4B.

FIG. 4B shows a blank B in accordance with this invention having a stop weld pattern 18 with a generally longitudinal serpentine configuration. The pattern 18 comprises a plurality of passes 19 connected by a plurality of bend portions 20 with the passes 19 oriented substantially to the longitudinal direction of the strip and the longitudinal axis of the resilient tube. This pattern 18 provides an inflated tube 21 as shown in FIG. 5. The pattern 18 of FIG. 4B provides for termination of the wall passage at either the same or opposing ends E of the tube 21. A tube 21 as shown in FIG. 5 has a wall passage 22 having low restriction to fluid flow because of the larger relative length of the passes 23 and the small number of bends 24.

A tube 21 as in FIG. 5 formed from the blank B of FIG. 4B has particular application in situations where it is desirable to heat or cool the tube 21 uniformly from one to the other. Such an applicaton might be for example the heating of a tube to improve the flow of a viscous fluid such as crude oil.

Figure 4C:
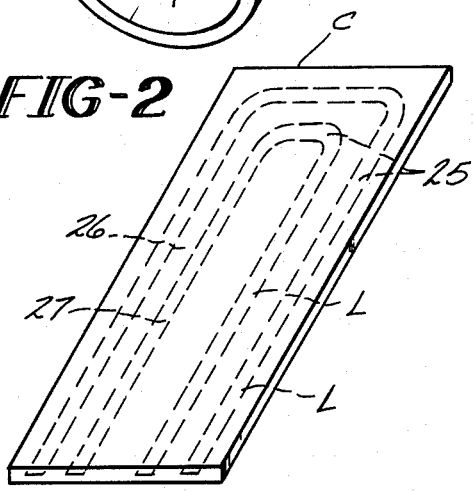
FIG. 4C is still another embodiment of the present invention and shows another bonded blank for formation into the tube of the present invention.
Figure 6:
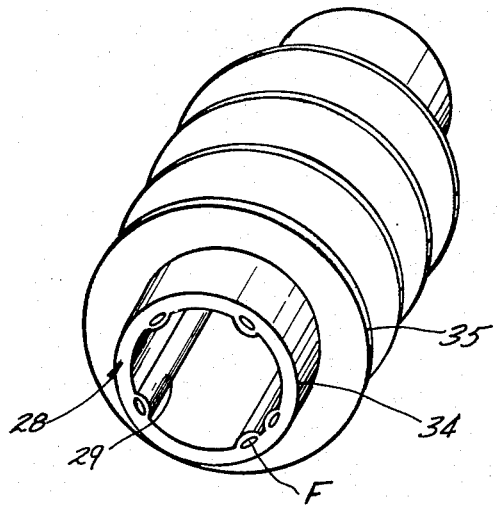
FIG. 6 is a respective tube of the present invention prepared from the blank of FIG. 4C including external fins.

FIG. 4C shows a blank C in accordance with this invention having a dual stop weld pattern 25 with U-shaped configurations. The pattern comprises two U-shaped patterns 26 and 27 oriented with the legs substantially parallel to the longitudinal direction of the blank C and the longitudinal axis of the resultant tube 28. This pattern 25 provides an inflated tube 28 as shown in FIG. 6. The pattern 25 of FIG. 4C provides for termination of the wall passages 29 at the same end E of the tube 28. This type of termination simplifies the plumbing arrangements required for connection to the wall passages 29. A tube 28 formed from the blank C of FIG. 4C is adapted for use in situations where it is necessary to flow more than one fluid through wall passages 29.

A tube 28 as in FIG. 6 formed from the blank C of FIG. 4C has particular applicaton in situations where it is desirable to heat or cool more than one fluid through the use of another fluid while maintaining separation between the fluids to be heated or cooled. A tube 28 as in FIG. 6 formed from the blank C of FIG. 4C also has the property that a temperture gradient exists from one side of the tube to the other. FIG. 6 also shows the application of external fins, 35, which will be discussed later.

In a practical situation, the inflation pressure required to cause permanent distension of the passage 2 wall will commonly fall within the range of 500 to 4000 psi, depending upon the metal, the degree of cold work in the metal, and the thickness of the passage walls. The difference in pressure from one side of the wall passage 2 to the other side, or differential pressure, acts to set up a state of stress within the wall passage wall. Permanent distension will occur only when the state of stress in the wall passages wall exceeds the yield stress for the metal alloy/condition which comprises the wall passage wall.

In the tube 3 of FIG. 3 the wall passage has been inflated without constraint and the resultant wall passage 2 protrudes interiorly and exteriorly of the tube wall 13.

In order to control or eliminate the degree of protrusion of the wall passage, it is necessary to control the pressure differential across the passage wall. If this pressure differential is reduced to below that which will cause yielding of the passage wall, no protrusion of the inflated passage will occur on that side of the tube wall where the pressure differentials is reduced.

The differential pressure which produces the state of stress equal to the yield stress of the passage wall, is denoted by the letter X. In order to eliminate protrusion of the inflated passage from one side of the tube, it is necessary to apply a counter balancing fluid pressure, denoted by the letter Y, to the inflation pressure, denoted by the letter Z, on that side of the tube such that the absolute value of the Y minus Z is less than or equal to X. If the above equation is not obeyed because the inflation pressure is too great, protrusion will occur. In the preferred embodiment, the absolute value of the differential pressure used falls in the range of 100 to 1500 psi.

A distension of the passage which causes the protrusion from the tube wall occurs only when differential pressure across the tube wall produces a stress within the tube wall which exceeds the yield point of the metal which comprises the tube wall. Control of this differential pressure can be used to control the protrusion of the wall passage and even to eliminate such protrusion from the inner or outer surface of the tube.

For certain heat exchange applications, it may be desirable to have the inner or outer of the tube essentially smooth. For example a smooth inner surface is conductive to higher fluid flow rates than an irregular or rough inner surface. For this reason the instant invention also includes a method and apparatus for inflating the wall passages so as to provide either a smooth inner or outer tube surface.

Referring to FIG. 5, there is shown a tube 21 having a smooth outer surface formed in accordance with this invention. The tube is formed from a blank as shown in FIG. 4B. All distension of the wall surface has taken place interiorly of the tube so that the wall passage 22 protrudes from the inner surface 33 of the tube 21 and does not protrude from the outer surface 32 of the tube.

A tube as in FIG. 5 is by virtue of its smooth outer surface 32 uniquely adapted to have heat exchange enhancement means affixed to its outer surface 32. For example a fin or tube configuration of conventional design can be provided as shown in FIG. 6 by affixing fin tock 35 to the smooth outer surface of the tube 28.

A typical application for such a heat exchange device is in the internal combustion engine wherein it is desirable to equilibrate the temperature of the cooling media and the engine oil while at the same time rejecting heat to the atmosphre. In use, the coolin media might be caused to flow through the tube 28 and the engine oil caused to flow through the wall passage 29. In use the cooling media and engine oil would approach the same temperature and heat would be rejected to the atmosphere.

Figure 7:
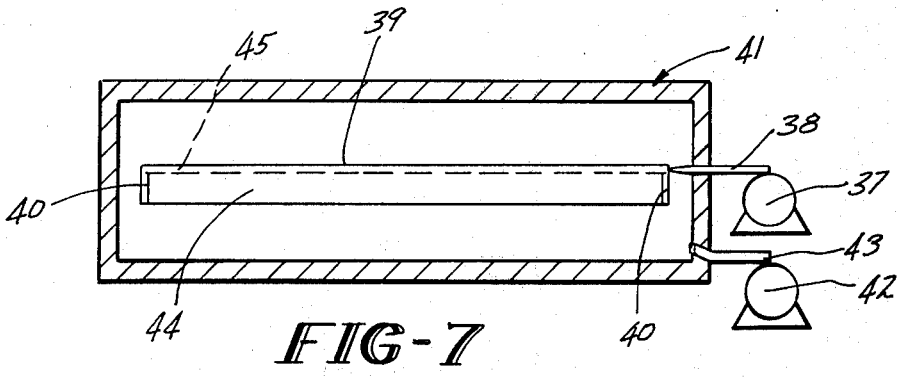
FIG. 7 is a partly schematic drawing showing the method and apparatus for formation of the tube of the present invention.

The method and apparatus for forming the tube 28 in accordance with FIG. 5 will be described with reference to FIG. 7.

Pump 37 applies fluid pressure through nozzle 38 to inflate the unwelded areas of the tube 44 as previously described. The tube is housed in sealed chamber. The ends of the tube are sealed by plugs 40 and 40 with the interior of the tube containing a fluid at a low pressure. The chamber 41 is pressurized by pump 42 through tube 43. The pressure applied by pump 42 is greater than the pressure applied by pump 37. By proper control of the relative values of the three pressures; the presence within the tube 44, the pressure within the wall passage 45 and the pressure within the sealed chamber 41, the inflation of the wall passage will be limited to the interior of the tube.

In a practical situation, the pressure required to cause the inflation of the wall passage 45 will commonly fall between 500 and 4000 psi, depending upon the metal and the thickness of the passage walls 39. In order to eliminate protrusion, it is necessary only that the pressure on the side of the tube from which the protrusion is to be eliminated exceed the pressure within the wall passage. In the preferred embodiment, the differential pressure falls in the range of 100 to 500 psi.

Figure 8:
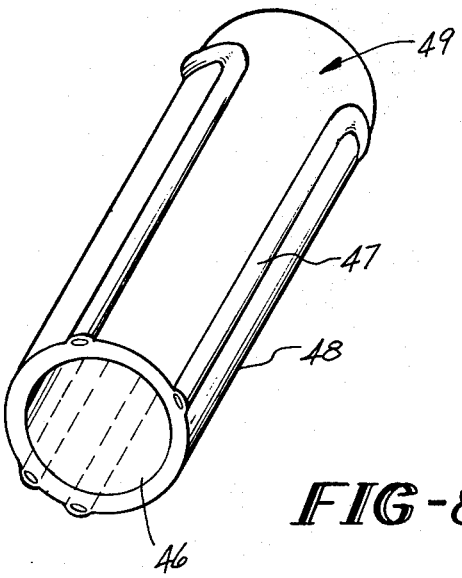
FIG. 8 is an alternative embodiment of tube formed from the blank of FIG. 4C.

FIG. 8 shows a tube 49 with a smooth inner surface 46 formed in accordance with this invention. The tube is formed from a blank of FIG. 4C. All distension of the wall passage 47 has taken place exteriorly of the tube 49. It is shown that the wall passage 47 protrudes from the outer surface 48 of the tube and does not protrude on the inner surface 46.

Figure 9:
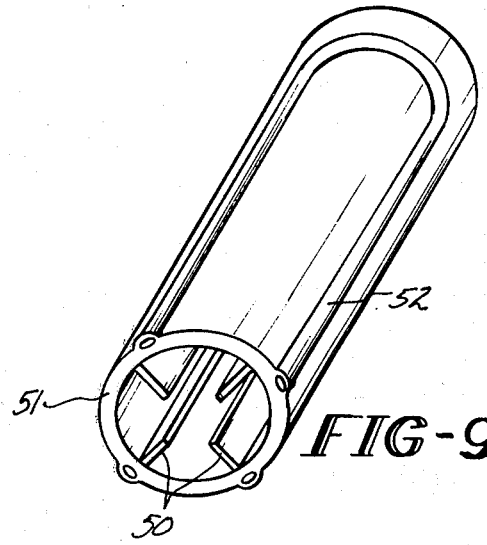
FIG. 9 is an alternative embodiment of the tube of the present invention formed from the blank of FIG. 4C including internal fins.

The tube 49 of FIG. 8 is by virtue of its smooth inner surface 46 uniquely adapted to have heat exchange enhancing means attached to its inner surface 46. For example, a series of essentially longitudinal inerior fins might easily be applied. This embodiment is shown in FIG. 9. Such interior fins 50 would serve to increase the heat transfer from the fluid flowing within the tube wall 51 and passages within the wall 52. Such fins 59 might be applied to the blank C of FIG. 4C prior to the formation of the tube 51 or might be applied to blank 6 of FIG. 4C during the tube forming operation. Such interior fins 50 would serve to decrease the required length of tube for a specific heat exchange application.

Figure 10:
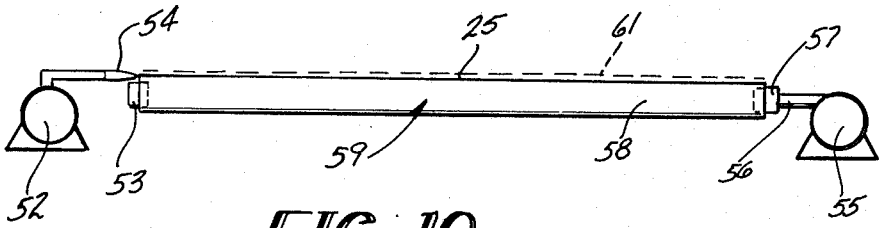
FIG. 10 is a partly schematic drawing of an alternative method and apparatus for the formation of tube of the present invention.

The method and apparatus for forming the tube 51 in accordance with the embodiment shown in FIG. 8 will be described with reference to FIG. 10. Fluid pressure is applied by pump 52 through nozzle 54 inserted in the top weld pattern 25 to cause inflation of the wall passage 61. Simultaneously, fluid pressure is applied by pump 55 through tube 56 and seal 57 to the interior of the tube 58. Seal 57 and plug 53 serve to seal the interior 58 of the tube. The pressure applied to the pump 55 exceeds the pressure applied by pump 52 and serves to restrict the expansion of the wall passage 25 solely to the exterior of the tube 59. The comments made during the discussion of FIG. 7 with regard to the differential pressure limits also apply to this apparatus.

Figure 11:
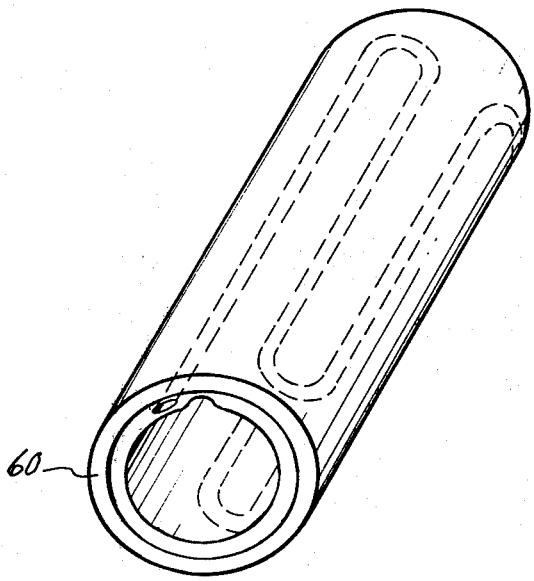
FIG. 11 is an alternative embodiment of tube of the present invention including the provision of external insulation.

In certain situations, it may be desirable to restrict heat transfer to be solely between the fluid flowing within the tube and the fluid flowing within the wall passage or passages. In this situation, it may be desirable to apply a layer of thermal insulation 60 to the exterior wall of the tube as shown in FIG. 11. Such insulation 60 may be of any conventional type as shown in the art; however, it is preferred to use a polymeric foam type insulation and even more preferred to use a rigid polyurethane foam type insulation which will add strength and stiffness to the resulting heat exchange structure.

The invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A hollow annular metal tube having a continuous circumferential wall, said wall having an inner surface and an outer surface, said wall containing a continuous passage located between said inner surface and said outer surface, said passage having a length at least 30% greater than the length of said tube and said wall having a continuous fluid-tight weld seam along its length wherein said inner surface is substantially free from protrusion of said passage, and wherein said tube has a plurality of fins attached to said outer surface thereof.

2. A heat exchanger for use with two or more fluids comprising a hollow annular metal tube having a continuous circumferential wall, said wall having an inner surface and an outer surface, said wall containing a continuous passage located between said inner surface and said outer surface, said passage having a length at least 130% greater than the length of said tube and said wall having a continuous fluig-tight weld seam along its length wherein said inner surface is substantially free from protrusion of said passage, and wherein said tube has a plurality of fins attached to said outer surface thereof.

3. A heat exchanger as in claim 2, wherein the said continuous passage between the said surfaces has a serpentine configuration.

* * * * *

UNITED STATES PATENT AND TRADEMARK OFFICE

CERTIFICATE OF CORRECTION

PATENT NO. : 3,991,822

DATED : November 16, 1976

INVENTOR(S) : Jack Morris

It is certified that error appears in the above-identified patent and that said Letters Patent are hereby corrected as shown below:

In Column 1, line 59, the word "embodiment" should read ---object---;

In Column 1, line 66, the word "not" should read ---no---.

In Column 2, line 16, the word "information" should read ---formation---;

In Column 2, line 26, the word "respective" should read ---representative---;

In Column 2, line 27, after "FIG. 4C" a comma (,) should be inserted;

In Column 2, line 46, the word "heating" should read ---heat---;

In Column 2, line 59, after the word "has" the word ---either--- should be inserted.

In Column 3, line 21, the word "as", second occurrence, to read -- is --.

In Column 3, line 47, the word "discs" should read ---dies---;

In Column 3, line 60, the word "wal" should read ---wall---.

In Column 4, line 30, the word "resilient" should read ---resultant---;

In Column 4, line 36, the word "larger" should read ---large---;

In Column 4, line 41, after the word "one" the word -- end -- should be inserted.

In Column 5, line 10, the word "passages" should read ---passage---;

UNITED STATES PATENT AND TRADEMARK OFFICE

CERTIFICATE OF CORRECTION

PATENT NO. : 3,991,822

DATED : November 16, 1976

INVENTOR(S) : Jack Morris

It is certified that error appears in the above-identified patent and that said Letters Patent are hereby corrected as shown below:

In Column 5, line 31, before the letter "Y" the word "the" should be deleted;

In Column 5, line 32, the sentence beginning with the word "If" should be a new paragraph;

In Column 5, line 36, "1500" should read ---500---;

In Column 5, line 66, the word "tock" should read ---stock---.

In Column 6, line 3, the word "coolin" should read ---cooling---;

In Column 6, line 14, the word ---a--- should be inserted after the word "in";

In Column 6, line 14, the numeral ---41--- should be inserted after the word "chamber";

In Column 6, line 21, the word "presence" should read ---pressure---;

In Column 6, line 59, the word "top" should read ---stop---.

In Column 7, line 13, the word "The" should read ---This---.

In Column 8, line 4, after the word "length" a comma (,) should be inserted;

In Column 8, line 15, "130%" should read ---30%---;

UNITED STATES PATENT AND TRADEMARK OFFICE

CERTIFICATE OF CORRECTION

PATENT NO. : 3,991,822

DATED : November 16, 1976

INVENTOR(S) : Jack Morris

It is certified that error appears in the above-identified patent and that said Letters Patent are hereby corrected as shown below:

In Column 8, line 16, the words "fluig-tight" should read ---fluid-tight---;

In Column 8, line 17, after the word "length" a comma (,) should be inserted.

Signed and Sealed this

Eighth Day of March 1977

[SEAL]

*Attest:*

RUTH C. MASON
*Attesting Officer*

C. MARSHALL DANN
*Commissioner of Patents and Trademarks*